US011905801B2

(12) United States Patent
Zhao et al.

(10) Patent No.: US 11,905,801 B2
(45) Date of Patent: Feb. 20, 2024

(54) BI-DIRECTIONAL SPRING CONE IN LINER HANGER SYSTEM

(71) Applicant: Schlumberger Technology Corporation, Sugar Land, TX (US)

(72) Inventors: Ming Zhao, Sugar Land, TX (US); Asif Javed, Perth (AU); James Hall, Spring, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 197 days.

(21) Appl. No.: 17/596,704

(22) PCT Filed: Jun. 29, 2020

(86) PCT No.: PCT/US2020/040103

§ 371 (c)(1),
(2) Date: Dec. 16, 2021

(87) PCT Pub. No.: WO2021/003089

PCT Pub. Date: Jan. 7, 2021

(65) Prior Publication Data

US 2022/0341297 A1 Oct. 27, 2022

Related U.S. Application Data

(60) Provisional application No. 62/869,225, filed on Jul. 1, 2019.

(51) Int. Cl.

| | |
|---|---|
| ***E21B 43/10*** | (2006.01) |
| ***E21B 23/01*** | (2006.01) |

(Continued)

(52) U.S. Cl.

CPC ..... *E21B 43/10* (2013.01); *E21B 23/01* (2013.01); *E21B 23/06* (2013.01); *E21B 33/1291* (2013.01)

(58) Field of Classification Search

CPC ..... E21B 43/10; E21B 23/01; E21B 23/06; E21B 33/1291

See application file for complete search history.

(56) References Cited

U.S. PATENT DOCUMENTS

| | | | | |
|---|---|---|---|---|
| 2,442,544 A | | 6/1948 | Johnson | |
| 3,976,133 A | * | 8/1976 | Allen | E21B 33/1295 166/134 |

(Continued)

FOREIGN PATENT DOCUMENTS

| | | | |
|---|---|---|---|
| CN | 106522868 | A | 3/2017 |
| WO | 2009137536 | A1 | 11/2009 |
| WO | 2017105562 | A1 | 6/2017 |

OTHER PUBLICATIONS

International Search Report and Written opinion issued in PCT application PCT/US2020/040103, dated Oct. 15, 2020 (14 pages).

(Continued)

*Primary Examiner* — Tara Schimpf
*Assistant Examiner* — Jennifer A Railey
(74) *Attorney, Agent, or Firm* — Jeffrey D. Frantz

(57) ABSTRACT

A system for hanging tubing in a wellbore includes a tubular body, a plurality of lower slips mounted along the tubular body, a spring cone disposed around the tubular body and fixed to the plurality of lower slips, the spring cone comprising a lock ring having a ratchet profile, and a packer element disposed around the tubular body, below and adjacent the spring cone.

19 Claims, 5 Drawing Sheets

(51) Int. Cl.
*E21B 23/06* (2006.01)
*E21B 33/129* (2006.01)

(56) References Cited

U.S. PATENT DOCUMENTS

| | | | | |
|---|---|---|---|---|
| 4,127,168 | A * | 11/1978 | Hanson | E21B 33/1295 166/131 |
| 5,749,585 | A * | 5/1998 | Lembcke | E21B 33/128 166/217 |
| 6,467,540 | B1 * | 10/2002 | Weinig | E21B 23/01 166/138 |
| 7,048,055 | B2 * | 5/2006 | Hirth | E21B 37/00 166/173 |
| 7,114,573 | B2 | 10/2006 | Hirth et al. | |
| 8,997,882 | B2 | 4/2015 | Turley et al. | |
| 2004/0177967 | A1 | 9/2004 | Hirth | |

OTHER PUBLICATIONS

Wilhelm A. Schneider, "Design and application of slotted cylinder springs", United States Army, USAELRDL Technical Report 2327, 1963. (29 pages).

* cited by examiner

BI-DIRECTIONAL SPRING CONE IN LINER HANGER SYSTEM

CROSS-REFERENCE TO RELATED APPLICATION

The present document is based on and claims priority to U.S. Provisional Patent Application Ser. No. 62/869,225, filed Jul. 1, 2019, which is incorporated herein by reference in its entirety.

BACKGROUND

A liner hanger system is used to hang a liner in a previously installed casing or liner. The system usually includes a liner hanger to provide anchoring and a packer to provide sealing. The slips on the hanger after set are engaged with the casing to provide the hanging load (in the downward direction). Hold-down slips on the liner top packer are meant to hold the load from the opposite direction (upward direction). The liner top packer also has an elastomeric element, which will be energized to seal the annulus between the liner and the casing after being set.

Normally, the liner hanger system is conveyed downhole with the liners using a running/setting tool. Hydraulically or mechanically, the slips are set by pushing a part having a cone profile to ramp the slips up to contact the casing. The upward load is usually due to the well accidental discharge, downhole frac/stimulation pumping operations. In a worst case scenario, this upward load could be larger than the hanging load (downward), which is the effective liner weight downhole. As a result, the packer slips could be relaxed due to this load reversal. The elastomeric element on the liner top packer may not be optimally energized due to the back off caused by the load reversal. As a result, the entire liner hanger system may fail to hang the liners or to seal the annulus, causing a catastrophic incident. Accordingly, there is a need to mitigate the risk of liner hanger system failure due to load reversal.

SUMMARY

A system for hanging tubing in a wellbore according to one or more embodiments of the present disclosure includes a tubular body, a plurality of lower slips mounted along the tubular body, a spring cone disposed around the tubular body and fixed to the plurality of lower slips, the spring cone comprising a lock ring having a ratchet profile, and a packer element disposed around the tubular body, below and adjacent the spring cone.

A method according to one or more embodiments of the present disclosure includes conveying a liner hanger system downhole into a cased wellbore, the liner hanger system including a tubular body, a plurality of lower slips mounted along the tubular body, a spring cone disposed around the tubular body and fixed to the plurality of lower slips, the spring cone including: a lock ring having a ratchet profile, and a cone profile, and a packer element disposed around the tubular body, below and adjacent the spring cone, the packer element including an elastomeric element, actuating the plurality of lower slips against the cone profile of the spring cone to create a setting load that forces the plurality of lower slips radially outward into engagement with the casing, and compresses the spring cone, and transferring the setting load through the spring cone to energize the packer element to seal an annulus between a liner and the casing, wherein the lock ring having the ratchet profile prevents the spring cone from moving in an upward direction after compression.

A method of manufacture according to one or more embodiments of the present disclosure includes dividing a cylinder into a plurality of sections arranged in sequence, cutting a plurality of slots into each section of the plurality of sections in a slot pattern, and disposing a lock ring having a ratchet profile near a middle of the cylinder.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the apparatus and/or method may be practiced without these details and that numerous variations or modifications from the described embodiments may be possible.

In the specification and appended claims: the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

The present disclosure generally relates to an apparatus and method to mitigate the risk of liner hanger system failure due to load reversal. More specifically, one or more embodiments of the present disclosure relate to an apparatus and method for spring loading components of the liner hanger system in case of the load reversal. According to one or more embodiments of the present disclosure, a bi-directional spring cone may provide the required retentive load to mitigate the risk of liner hanger system failure due to load reversal.

Figure 1:
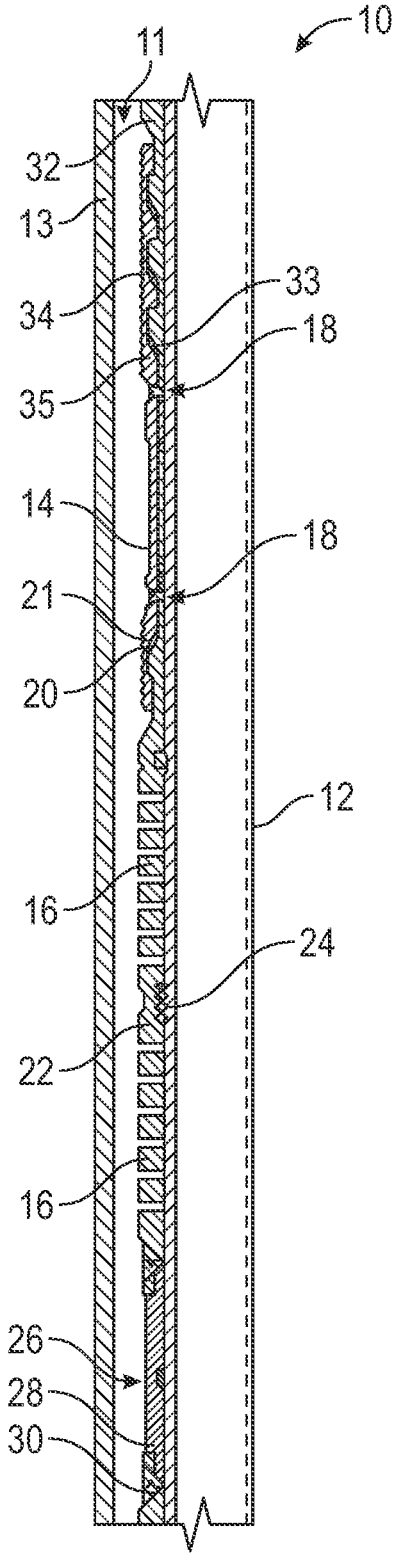
FIG. 1 is an illustration of a liner hanger system with a spring cone according to one or more embodiments of the present disclosure.

Referring generally to FIG. 1, an illustration of a liner hanger system with a spring cone according to one or more embodiments of the present disclosure is shown. The liner hanger system 10 may be used to suspend a liner in a wellbore 11 that has been cased with a casing 13. In one or more embodiments of the present disclosure, the liner hanger system 10 may be conveyed downhole into the cased wellbore 11 using a running or setting tool, for example. As shown in FIG. 1, the liner hanger system 10 includes a tubular body 12 and a lower slip 14 mounted along the tubular body 12. In one or more embodiments of the present disclosure, the lower slip 14 may include teeth, ratcheting, or gripping elements to allow the lower slip 14 to bite into and grip the casing 13. Although only one lower slip 14 is shown in FIG. 1, a plurality of lower slips 14 may be mounted along the tubular body 12 according to one or more embodiments of the present disclosure.

As further shown in FIG. 1, the liner hanger system 10 may also include a spring cone 16 disposed around the tubular body 12 and fixed to the lower slip 14. In one or more embodiments of the present disclosure, the spring cone 16 may be fixed to the lower slip 14 with at least one shear screw 18. Moreover, the spring cone 16 may include a cone profile 20 that is configured to engage a corresponding profile 21 of the lower slip 14. While FIG. 1 shows that the cone profile 20 of the spring cone 16 may be located near an end of the spring cone 16, as long as the cone profile 20 is configured to engage a corresponding profile 21 of the lower slip 14, the cone profile 20 may be located at another location along the spring cone 16 without departing from the scope of the present disclosure. In one or more embodiments of the present disclosure, the spring cone 16 may also include a lock ring 22 having a ratchet profile 24 located near a middle of the spring cone 16. The lock ring 22 with the ratchet profile 24 is further described below.

As further shown in FIG. 1, the liner hanger system 10 may also include a packer element 26 disposed around the tubular body 12. In one or more embodiments of the present disclosure, the packer element 26 may include an elastomeric element 28. The elastomeric element 28 of the packer element 26 may be located near a top of a lower liner section 30 for sealing a liner to the casing 13 according to one or more embodiments of the present disclosure.

Still referring to FIG. 1, the liner hanger system 10 according to one or more embodiments of the present disclosure may also include an upper cone 32 disposed around the tubular body 12. As shown in FIG. 1, the upper cone 32 may include an engagement profile 33 in accordance with one or more embodiments of the present disclosure. As further shown in FIG. 1, the liner hanger system 10 may also include an upper slip 34 fixed to the upper cone 32. The upper slip 34 may be fixed to the upper cone 32 via a shear screw 18, for example. In one or more embodiments of the present disclosure, the upper slip 34 may include a corresponding profile 35 to the engagement profile 33 of the upper cone 32. Although only one upper slip 34 is shown in FIG. 1, a plurality of upper slips 34 may be fixed to the upper cone 32 according to one or more embodiments of the present disclosure.

Figure 2:
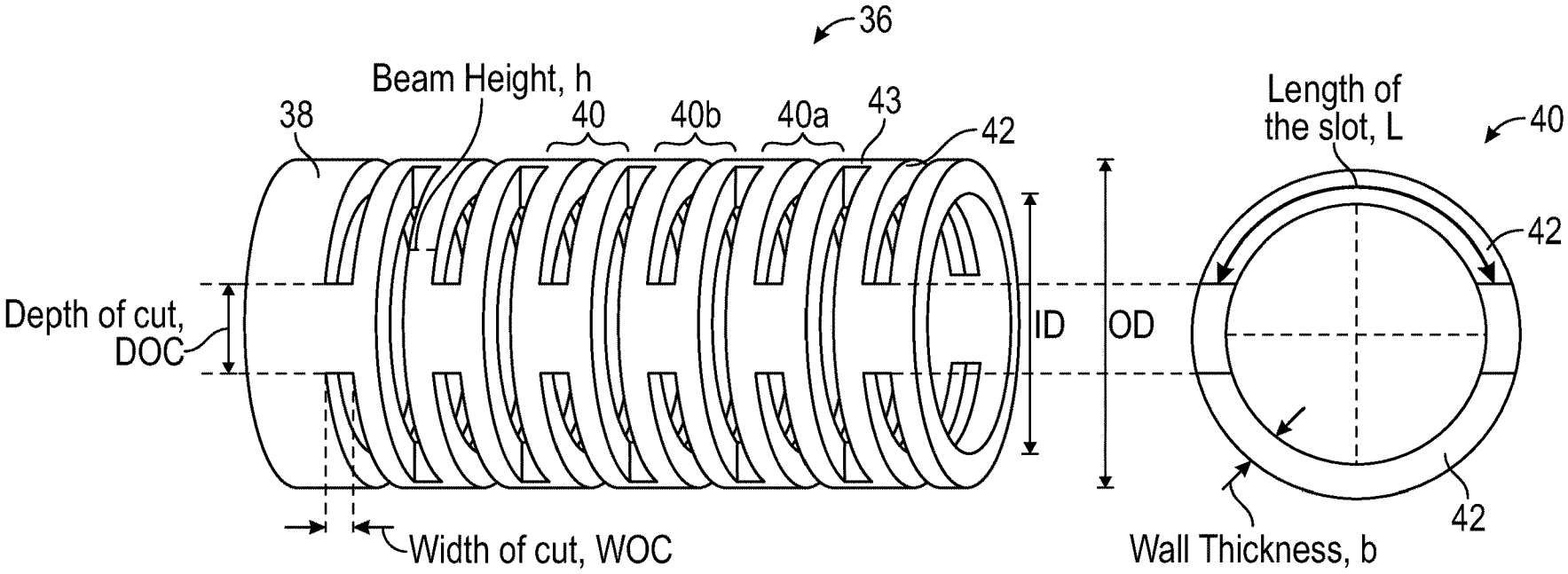
FIG. 2 is a slotted cylinder spring with associated geometric parameters according to one or more embodiments of the present disclosure.

Referring now to FIG. 2, a slotted cylinder spring with associated geometric parameters according to one or more embodiments of the present disclosure is shown. Indeed, the spring cone 16, as previously described, may be a slotted cylinder spring according to one or more embodiments of the present disclosure. Advantageously, the slotted cylinder spring is able to provide high load capacity and low deflection in a limited size. As shown in FIG. 2, in accordance with one or more embodiments of the present disclosure, the slotted cylinder spring 36 may be made by dividing a cylindrical pipe body 38 into a plurality of sections 40 arranged in sequence, cutting a plurality of slots 42 into each section 40 of the plurality of sections 40 in a slot pattern, and disposing a lock ring 22 having a ratchet profile 24 near a middle of the cylindrical pipe body 38. In one level on the circumference of the cylindrical pipe body 38 (i.e., one section 40), the slotted cylinder spring 36 has a number of slots 42 per section 40 ($N_s$). In one or more embodiments of the present disclosure, $N_s$ can be 2, 3, 4, or more, for example. To achieve a slot pattern according to one or more embodiments of the present disclosure, a next section 40 of the cylindrical pipe body 38 may have the same $N_s$ but with $180/N_s$ degrees of rotation, so that a vertical path 43 is located at the center of the previous slot 42. With a number of sections 40 ($N_{ss}$) arranged in sequence, one spring cone 16 according to one or more embodiments of the present disclosure may be obtained. According to one or more embodiments of the present disclosure, $N_{ss}$ may be 4, 5, 6, 7, 8, or more, for example.

Still referring to FIG. 2, the slotted cylinder spring 36 of the spring cone 16 may include various material properties and geometric parameters to govern the spring performance of the spring cone 16. For example, FIG. 2 shows geometric parameters of the slotted cylinder spring 36 such as the inner diameter ID, the outer diameter OD, beam height h, width of cut WOC, depth of cut DOC, length of slot L, and wall thickness b. Based on the geometric parameters of the slotted cylinder spring 36, the spring stiffness (K) may be derived using Equation 1, where F is the force on the cylindrical pipe body 38, $\delta_{tot}$ is the total displacement produced by the force, i.e., the change in length of the cylindrical pipe body 38, E is the Young's Modulus, which is measured as stress $\sigma$ (or uniaxial force per unit surface) over strain $\epsilon$ (or change in length divided by original length), i.e., $$\frac{\sigma}{\varepsilon},$$

and the other geometric parameters are as previously defined.

$$K = \frac{F}{\delta_{tot}} = \frac{16 \cdot N_S \cdot b \cdot h^3 \cdot E}{N_{SS} \cdot L^3} \qquad \text{Eq. 1}$$

Also based on the geometric parameters of the slotted cylinder spring 36, the spring total length $L_s$ may be derived using Equation 2, where the geometric parameters are as previously defined.

$$L_s=(N_{ss}+1)\cdot(h+WOC)+h \qquad \text{Eq. 2}$$

Based on the required load on the lower slips 14 (and/or the upper slips 34) and the elastomeric element 28 of the packer element 26, the geometric parameters as previously described may be designed to yield superior spring performance. Regarding materials, the slotted cylinder spring 36 may be made of 150 KSI 17-4 PH Stainless Steel (Smith Material Spec. ES4.39251) to achieve an ultra-high load for liner hanger applications in accordance with one or more embodiments of the present disclosure. However, depending on the application, the slotted cylinder spring 36 may be made out of other materials, such as 4130/4140 Steel, for example, without departing from the scope of the present disclosure.

Figure 3A:
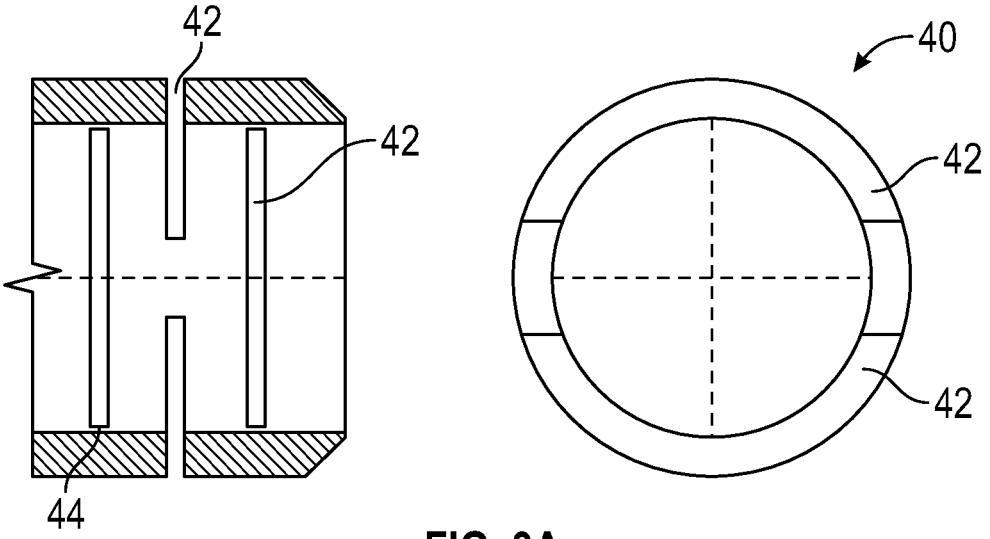
FIGS. 3A and 3B are examples of different types of slots according to one or more embodiments of the present disclosure.
Figure 3B:
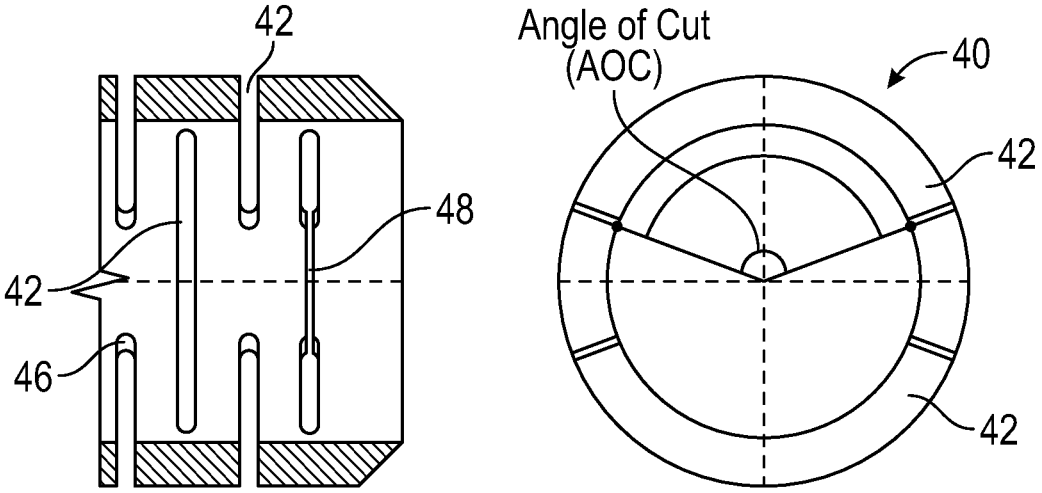

Referring now to FIGS. 3A and 3B, examples of different types of slots 42 according to one or more embodiments of the present disclosure are shown. There may be various ways to cut the slots 42 into the cylindrical pipe body 38 in accordance with one or more embodiments of the present disclosure, including the straight cut 44 shown in FIG. 3A, and the radial cut 46 shown in FIG. 3B, for example. Other types of cuts having different shapes or geometric configurations are contemplated and may be within the scope of the present disclosure. In one or more embodiments of the present disclosure, the straight cut 44, such as that shown in FIG. 3A, is relatively easy, cost saving, and more suitable for smaller slot 42 widths. In one or more embodiments of the present disclosure, the radial cut 46, such as that shown in FIG. 3B, can minimize the difference of the arc length on the OD and ID of the cylindrical pipe body 38, making the slot 42 deflection more uniform, especially when the slot 42 width is relatively large. As further shown in FIG. 3B, a slot 42 may include at least one nub 48. Although FIG. 3B shows that the slot 42 having radial cuts 46 includes the at least one nub 48, slots 42 having straight cuts 44 or other types of cuts having different shapes or geometric configurations may also include at least one nub 48 in accordance with one or more embodiments of the present disclosure. The functionality of the at least one nub 48 is further described below with respect to FIG. 4.

Figure 4:
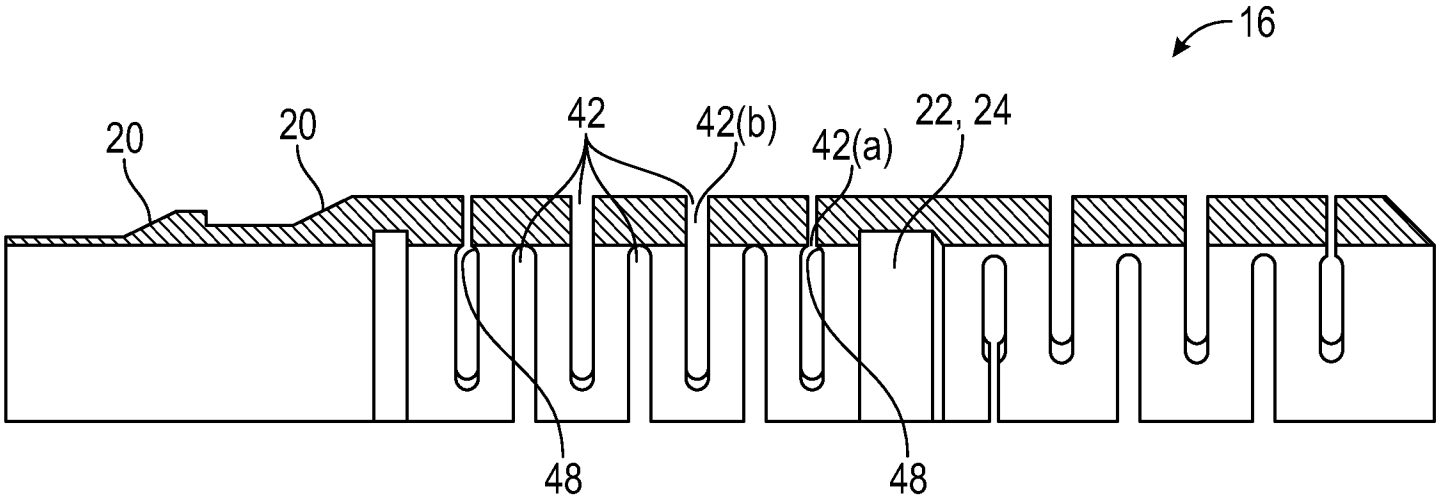
FIG. 4 is a bi-directional spring cone before setting according to one or more embodiments of the present disclosure.
Figure 5:
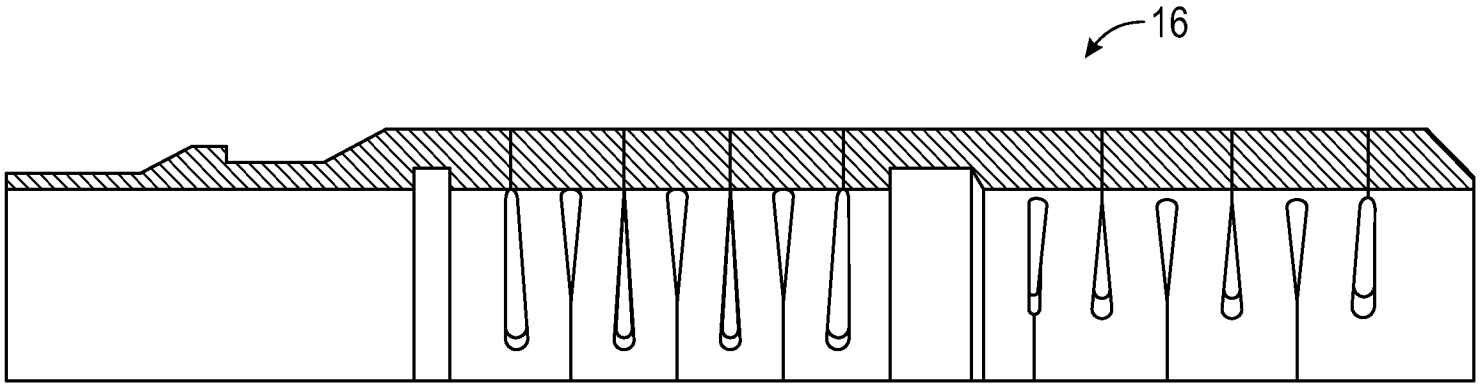
FIG. 5 is a bi-directional spring cone after setting according to one or more embodiments of the present disclosure.

Referring now to FIG. 4, a bi-direction spring cone 16 before setting according to one or more embodiments of the present disclosure is shown. As shown in FIG. 4, the spring cone 16 includes a plurality of slots 42, at least one nub 48, a lock ring 22 having a ratchet profile 24 near a middle of the spring cone 16, and a cone profile 20 as previously described. As further shown in FIG. 4, the at least one nub 48 may be added on each of the end slots 42(*a*) according to one or more embodiments of the present disclosure. The end slots 42(*a*) are there to transfer the load to the "effective" slots 42(*b*) during setting in accordance with one or more embodiments of the present disclosure. As shown, the at least one nub 48 reduced the end slot 42(*a*) width by half, which forces all the slots 42 to close once the spring cone 16 is fully compressed (FIG. 5). Full radius on the end slot 42(*a*) helps reduce the stress concentration and therefore reduces local plastic deformation.

As further shown in FIG. 4, the spring cone 16 before setting is in an uncompressed state. As previously described with respect to FIG. 1, shear screws 18 may fix the lower slip 14 to the spring cone 16 and the upper slip 34 to the upper cone 32, according to one or more embodiments of the present disclosure. When sufficient pressure of hydraulic fluid or other sufficient mechanical pressure is applied to an actuator (not shown) of the liner hanger system 10, the shear screws 18 may shear to enable shifting or actuation of the lower slip 14 and the upper slip 34. That is, when the shear screws 18 shear, the lower slip 14 shifts against the cone profile 20 of the spring cone 16 to create a setting load that forces the lower slip 14 radially outward into engagement with the casing 13 and compresses the spring cone 16. When engaged with the casing 13, the lower slip 14 provides a hanging load in a downward direction. In one or more embodiments, the shearing of the shear screws 18 also causes the upper slip 34 to shift against the engagement profile 33 of the upper cone 32 to force the upper slip 34 radially outward into engagement with the casing 13. In one or more embodiments of the present disclosure, the generated setting load may be transferred through the spring cone 16 to energize the adjacent elastomeric element 28 of the packer element 26 to seal an annulus between a liner and the casing 13. That is, after setting, the lower slip 14 and/or the upper slip 34 may engage the casing 13, the spring cone 16 may be compressed, and the elastomeric element 28 of the packer element 26 may seal an annulus between the liner and the casing 13. As shown in FIG. 5, for example, the spring cone 16 gets solid and is in a compressed state after setting in accordance with one or more embodiments of the present disclosure.

Advantageously, according to one or more embodiments of the present disclosure, the lock ring 22 having the ratchet profile 24 of the spring cone 16 prevents the spring cone 16 from moving in an upward direction after compression. Moreover, if an upward load in the liner hanger system 10 exceeds the hanging load provided by the lower slip 14 when engaged with the casing 13, i.e., if load reversal occurs, the spring cone 16 relaxes in the upward direction and the downward direction. That is, in case of any load reversal, the relaxation in the axial direction by the spring cone 16 will be compensated by the spring load. As such, the lower slips 14 and elastomeric element 28 of the packer element 26 may be effectively spring loaded if load reversal occurs in accordance with one or more embodiments of the present disclosure. Advantageously, the lock ring 22 having the ratchet profile 24 allows the spring cone 16 to relax independently in both directions.

Still referring to FIGS. 4 and 5, it is not necessary to design the same slot pattern on both sides of the spring cone 16. Indeed, the load and possible deflection requirement for loading the lower slips 14 and elastomeric element 28 of the packer element 26 may be different. Therefore, different spring performance may be designed on both sides to meet different requirements, according to one or more embodiments of the present disclosure.

Figure 6:
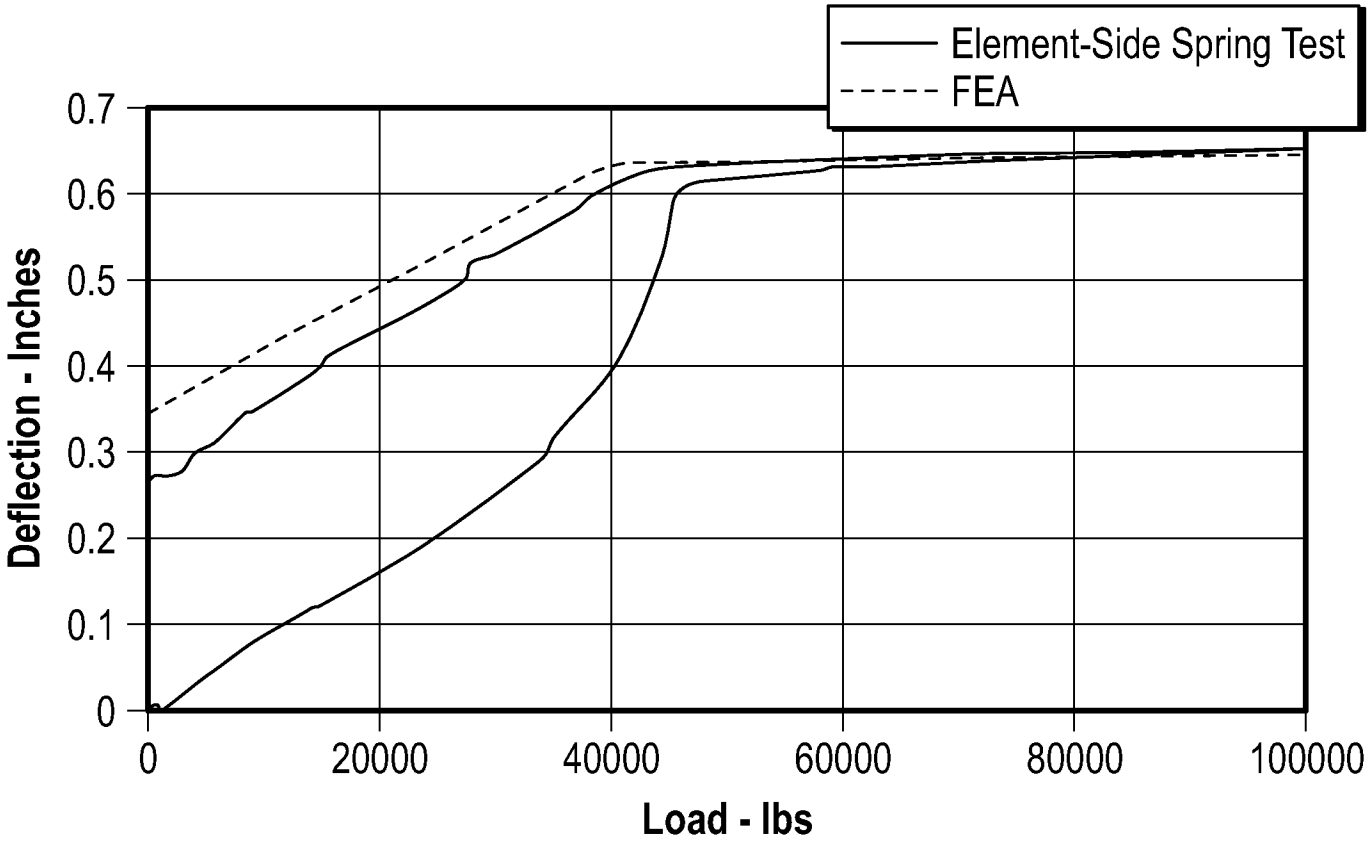
FIG. 6 is an example of spring cone load-deflection performance according to one or more embodiments of the present disclosure.

Referring now to FIG. 6, an example of spring cone 16 load-deflection performance according to one or more embodiments of the present disclosure is shown. Specifically, FIG. 6 shows an example of the load deflection curve of the spring cone 16. As shown, at a setting load of about 60,000 lbs, for example, the spring cone 16 gets fully solid (i.e., fully closed as shown in FIG. 5). In case of any relaxation, due to the lock ring 22 having the ratchet profile 24, the spring cone 16 is still able to provide sufficient load to maintain the setting position of the lower slips 14 and the elastomeric element 28 of the packer element 26.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for hanging tubing in a wellbore, comprising:

a tubular body;

a plurality of lower slips mounted along the tubular body;

a spring cone disposed around the tubular body and fixed to the plurality of lower slips, the spring cone comprising a cone profile, a spring including a plurality of slots, and a lock ring including a ratchet profile, wherein the lock ring is disposed between a first slot and a second slot of the plurality of slots; and a packer element disposed around the tubular body, below and adjacent the spring cone.

2. The system of claim 1, wherein the spring cone further comprises a cylinder having a plurality of sections arranged in sequence.

3. The system of claim 2, wherein each section of the plurality of sections comprises two or more slots of the plurality of slots.

4. The system of claim 3, wherein the plurality of slots comprises at least one straight cut slot.

5. The system of claim 3, wherein the plurality of slots comprises at least one radial cut slot.

6. The system of claim 3, wherein at least one slot of the plurality of slots comprises at least one nub.

7. The system of claim 1, wherein the spring cone is fixed to the plurality of lower slips with at least one shear screw.

8. The system of claim 1, further comprising:

an upper cone disposed around the tubular body, the upper cone comprising an engagement profile; and a plurality of upper slips comprising a corresponding profile to the engagement profile, wherein the plurality of upper slips is fixed to the upper cone.

9. A method, comprising:

conveying a liner hanger system downhole into a cased wellbore, the liner hanger system comprising:

a tubular body;

a plurality of lower slips mounted along the tubular body;

a spring cone disposed around the tubular body and fixed to the plurality of lower slips, the spring cone comprising:

a spring including a plurality of slots;

a lock ring including a ratchet profile, wherein the lock ring is disposed between a first slot and a second slot of the plurality of slots; and a cone profile; and a packer element disposed around the tubular body, below and adjacent the spring cone, the packer element comprising an elastomeric element;

actuating the plurality of lower slips against the cone profile of the spring cone to create a setting load that forces the plurality of lower slips radially outward into engagement with a casing, and compresses the spring cone; and transferring the setting load through the spring cone to energize the packer element to seal an annulus between a liner and the casing, wherein the lock ring having the ratchet profile prevents the spring cone from moving in an upward direction after compression.

10. The method of claim 9, wherein the plurality of lower slips provides a hanging load in a downward direction when engaged with the casing, and wherein, if an upward load in the liner hanger system exceeds the hanging load, a first portion the spring cone including the first slot relaxes in the upward direction and a second portion of the spring cone including the second slot relaxes in the downward direction.

11. The method of claim 10, wherein relaxation of the first portion of the spring cone in the upward direction and relaxation of the second portion of the spring cone in the downward direction maintains the plurality of lower slips in engagement with the casing, and keeps the packer element energized to seal the annulus between the liner and the casing.

12. The method of claim 9, wherein the liner hanger system is conveyed downhole into the cased wellbore using a running tool.

13. The method of claim 9, wherein the spring cone further comprises a cylinder having a plurality of sections arranged in sequence.

14. The method of claim 9, wherein the liner hanger system further comprises:

an upper cone disposed around the tubular body, the upper cone comprising an engagement profile; and a plurality of upper slips comprising a corresponding profile to the engagement profile, wherein the plurality of upper slips is fixed to the upper cone, the method further comprising:

actuating the plurality of upper slips against the engagement profile of the upper cone to force the plurality of upper slips radially outward into engagement with the casing.

15. A method of manufacture of a slotted cylindrical spring, comprising:

dividing a cylinder into a plurality of sections arranged in sequence, a first section of the plurality of sections is disposed between a second section and a third section of the plurality of sections;

cutting a plurality of slots into each section of the plurality of sections of the cylinder in a slot pattern to form the slotted cylindrical spring; and disposing a lock ring including a ratchet profile on the first section after cutting the plurality of slots.

16. The method of claim 15, wherein cutting the plurality of slots comprises cutting at least one straight slot.

17. The method of claim 15, wherein cutting the plurality of slots comprises cutting at least one radial slot.

18. The method of claim 15, wherein at least one slot of the plurality of slots comprises at least one nub.

19. The method of claim 15, further comprising creating a cone profile near an end of the cylinder.

* * * * *